US008197008B2

(12) United States Patent
Stell

(10) Patent No.: US 8,197,008 B2
(45) Date of Patent: Jun. 12, 2012

(54) RECONFIGURABLE FURNITURE PIECE

(76) Inventor: Ian Stell, New York, NY (US)

( * ) Notice: Subject to any disclaimer, the term of this patent is extended or adjusted under 35 U.S.C. 154(b) by 496 days.

(21) Appl. No.: 12/402,924

(22) Filed: Mar. 12, 2009

(65) Prior Publication Data

US 2009/0230734 A1 Sep. 17, 2009

Related U.S. Application Data

(60) Provisional application No. 61/069,359, filed on Mar. 14, 2008.

(51) Int. Cl.
*A47C 7/00* (2006.01)

(52) U.S. Cl. ..... 297/440.12; 297/440.15

(58) Field of Classification Search ..... 297/440.12, 297/440.1, 440.14, 440.15
See application file for complete search history.

(56) References Cited

U.S. PATENT DOCUMENTS

| | | | | |
|---|---|---|---|---|
| 2,692,639 | A | 10/1954 | Genovese | |
| 2,693,846 | A | 11/1954 | Luttio | |
| 2,896,695 | A | 7/1959 | Ashworth | |
| 4,025,106 | A | 5/1977 | Kyte | |
| 4,841,882 | A * | 6/1989 | Ehrman | 297/440.12 X |
| 4,925,245 | A | 5/1990 | Pendleton et al. | |
| 5,921,621 | A | 7/1999 | Cook et al. | |
| 6,116,682 | A | 9/2000 | Baur | |
| 6,170,908 | B1 | 1/2001 | Jewell | |
| 7,261,377 | B2 | 8/2007 | Ehud | |

FOREIGN PATENT DOCUMENTS

FR 2707854 1/1995

OTHER PUBLICATIONS

Reinharddienes, Projects_furniture, Juan, http://www.reinhard-dienes.com/index.php?article_id=28, Accessed on web Jun. 15, 2009.

Reinharrdienes, Projects_furniture, Pedro, http://www.reinhard-dienes.com/index.php?article_id=29, Accessed on web Jun. 15, 2009.

Reinharrdienes, Projects_furniture, Pablo, http://www.reinhard-dienes.com/index.php?article_id=30, Accessed on web Jun. 15, 2009.

Designlines, Pablo, Pedro and Juan, machine translation of German text provided, http://www.designlines.de/newcomer/Pablo-Pedro-und-juan_663157.html?bildnr=4, Accessed on web Jun. 15, 2009.

Designboom, Prop Chair, http://www.designboom.com/london03/112.html, Accessed on web Mar. 12, 2008.

(Continued)

*Primary Examiner* — Anthony D Barfield

(74) *Attorney, Agent, or Firm* — Weingarten, Schurgin, Gagnebin & Lebovici LLP

(57) ABSTRACT

A reconfigurable piece of furniture having a two-dimensional pattern for storage and multiple three-dimensional functional patterns. The furniture piece includes a central base portion of circular, oval or polygonal shape, pivoting members disposed at discrete locations along an edge of the central base portion; plural radiating members that are bi-directionally pivotally or foldably attached to a corresponding pivoting member; and fastening members disposed on corresponding portions of radiating members. After pivoting or rotating the radiating members, adjacent radiating members are releasably secured to each other to provide structure to adjacent radiating members, forming a three-dimensional furniture piece.

18 Claims, 19 Drawing Sheets

OTHER PUBLICATIONS

Designboom, Stige Stool, http://www.designboom.com/london03/289.html, Accessed on web Mar. 12, 2008.

Designboom, Clip Clap, http://www.designboom.com/london03/775.html, Accessed on web Mar. 12, 2008.

Designboom, Gap, http://www.designboom.com/london03/1302.html, Accessed on web Mar. 12, 2008.

Gadget Venue, Hanging Chair, http://www.gadgetvenue.com/hanging-chair-09215353, Accessed on web Mar. 12, 2008.

Inhabitat, Studio Dror's Pick Chair, http://www.inhabitat.com/2006/03/22/studio-drors-pick-chair/, Accessed on web Mar. 12, 2008.

Gregg Fleishman, Sculpt Chairs, http://www.greggfleishman.com/furniture.html, Accessed on web Mar. 12, 2008.

FlexibleLove: Experimental Furniture Made From Recycled Cardboard, http://www.flexiblelove.com, Accessed on web Mar. 12, 2008.

Designboom, Origami Chair, http://www.designboom.com/london03/973.html, Accessed on web Mar. 12, 2008.

Designboom, Fanfan Chair, http://www.designboom.com/london03/1178.html, Accessed on web Mar. 12, 2008.

Campmor, Camp Time Roll-a-Chair, http://www.campmor.com/webapp/wcs/stores/servlet/ProductDisplay?AFC-shop-zilla&pro . . . , Accessed on web Mar. 12, 2008.

* cited by examiner

RECONFIGURABLE FURNITURE PIECE

CROSS REFERENCE TO RELATED APPLICATIONS

Priority of U.S. Provisional Patent Application No. 61/069,359, which was filed on Mar. 14, 2008, is claimed.

STATEMENT REGARDING FEDERALLY SPONSORED RESEARCH OR DEVELOPMENT (Not applicable)

BACKGROUND OF THE INVENTION

Reconfigurable furniture is disclosed and, more particularly, reconfigurable furniture having a substantially two-dimensional (2-D) configuration for storage and a plurality of three-dimensional (3-D) configurations for use. Reconfigurable pieces of furniture are well known to the art as economy and innovation has motivated designers to produce furniture patterns that can be configured into two or more different pieces of furniture. For example, U.S. Pat. No. 2,693,846 to Luttio, U.S. Pat. No. 2,896,695 to Ashworth, and U.S. Pat. No. 6,170,908 to Jewell disclose convertible pieces that, in a first configuration, become ottomans, hassocks, and foot stools, respectively, while, in a second configuration, become chairs. Disadvantageously, the configurations are 3-D making storage more difficult. U.S Pat. No. 7,261,377 to Ehud partially resolves this storage shortcoming by making the multi-functional furniture pieces stackable. However, storage and use are both 3-D. Accordingly, it would be desirable to provide a multi-function furniture piece that has a substantially 2-D configuration that facilitates storage of the thin, flat patterns.

Folding or collapsible tables and chairs, that had a 2-D configuration for storage are also known to the art. For example, the "prop chair", the "clip clap", and a "hanging chair" are embodiments of a piece of 3-D furniture that can be reconfigured as a relatively flat, 2-D pattern for easier storage, e.g., by hanging on a wall. These pieces, however, are not multi-functional, which is to say that the 2-D pattern is limited to a single 3-D form that is either a chair or a table but not both. Accordingly, it would be desirable to provide a multi-function, reconfigurable furniture piece that has a substantially 2-D configuration to facilitate storage when not being used and multi-functional 3-D configurations for multiple uses.

BRIEF SUMMARY OF THE INVENTION

A reconfigurable piece of furniture having a two-dimensional pattern for storage and multiple three-dimensional functional pattern is disclosed. The furniture piece includes a central base portion, plural radiating members, and fastening members. The central base portion is of circular, oval or polygonal shape having a top surface and a bottom surface. A plurality of pivoting members are disposed at discrete location along an edge about the periphery thereof.

The radiating members are pivotally or foldably attached to the central base portion via corresponding pivoting members that are adapted to permit bi-directionally movement. A plurality of fastening members are disposed on portions of each radiating members such that conjugate fastening members on adjacent radiating members can be reliably secured once the radiating members are pivoted or folded into a three-dimensional pattern. Once secured, the radiating members provide structure to create a three-dimension piece of furniture.

More particularly, a first portion of the plurality of radiating members is orthogonally pivoted or folded about the central base portion to provide a support portion. The first portion may comprise all or substantially all of the plurality of radiating members to generate a furniture piece having a substantially horizontal upper surface such as a table, a stool, a footrest, and an ottoman. Alternatively, a second portion of the plurality of radiating members can be orthogonally pivoted or folded about the central base portion opposite in an opposite direction to that of the first plurality of radiating members, to provide a backrest portion and/or an armrest portion, to provide a chair or a backed bar stool.

Optionally, the central base portion can include plural individual base portions, each of which provides an edge(s) having a pivoting member(s). Each of the individual base portions is further adapted to be releasably attachable to a corresponding individual base portion.

Preferably, when the plurality of radiating members is pivoted or folded about the central base portion in a first direction the members can support an object placed on a first (top) surface of the central base portion and when the radiating members are pivoted or folded about the central base portion in a second, opposite direction the members can support an object placed on a second (bottom) surface of the central base portion.

A method of reconfiguring a two-dimensional pattern into multiple three-dimensional pieces of furniture is also disclosed. The method includes pivoting or folding each of the radiating members towards at least one of the first and the second surfaces of the central base portion, to generate a three-dimensional structure; and releasably securing corresponding portions of the radiating members to conjugate corresponding portions of adjacent radiating members to provide structure to generate the three-dimension piece of furniture.

BRIEF DESCRIPTION OF THE SEVERAL VIEWS OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Reconfigurable furniture pieces, e.g., chairs, stools, tables, ottomans, footrests, and any combination thereof, will now be described. In this description various discrete embodiments of the invention will be described in terms of a fixed number of radiating members. This is done for illustrative purposes only and not for the purpose of limitation. Indeed, those of ordinary skill in the art can appreciate that the basic structure of the reconfigurable furniture disclosed herein can include any reasonable and functional number of radiating members.

Figure 1:
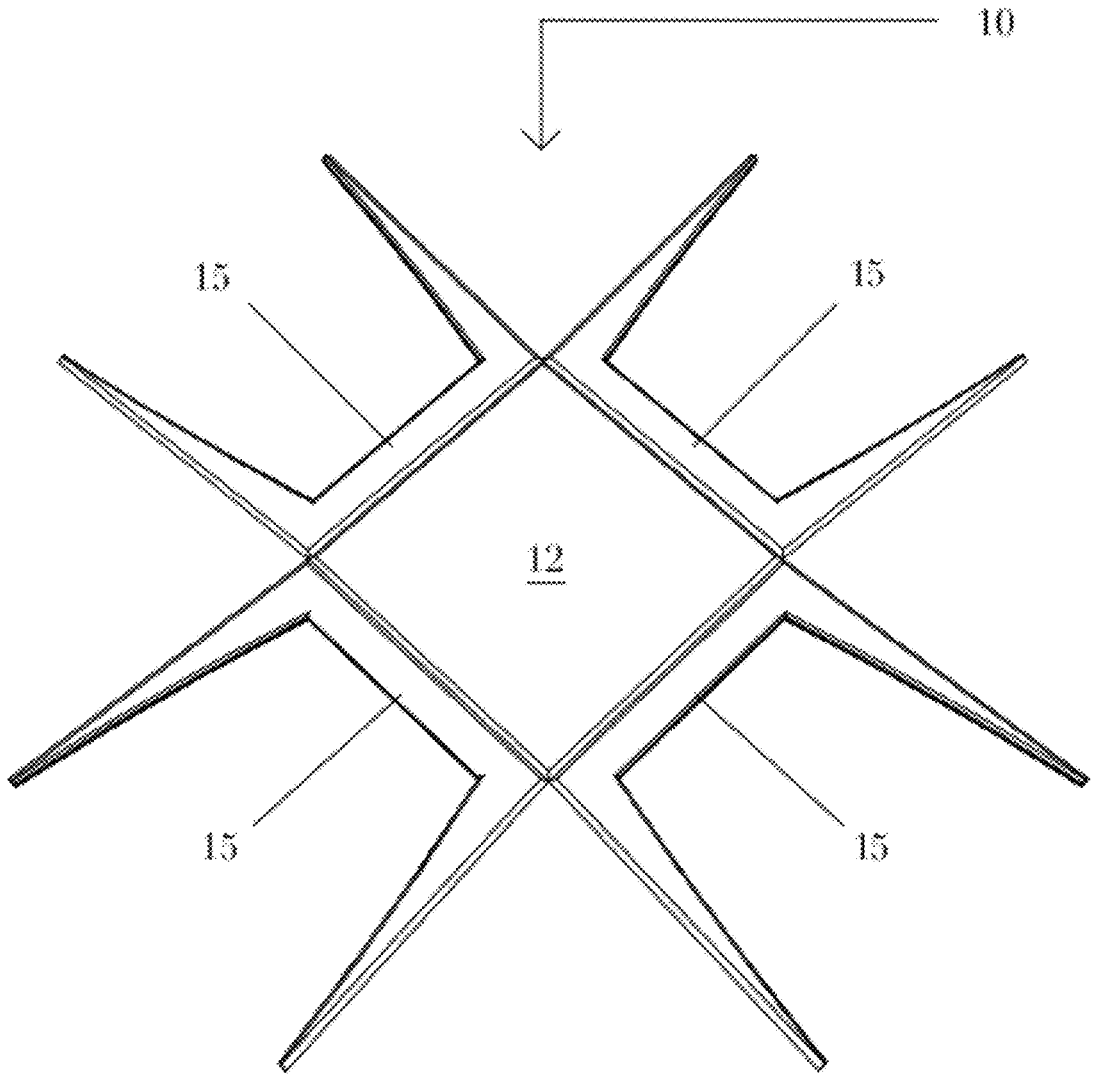
FIG. 1 shows a four-sided embodiment of a reconfigurable furniture piece in accordance with the present invention.
Figure 2:
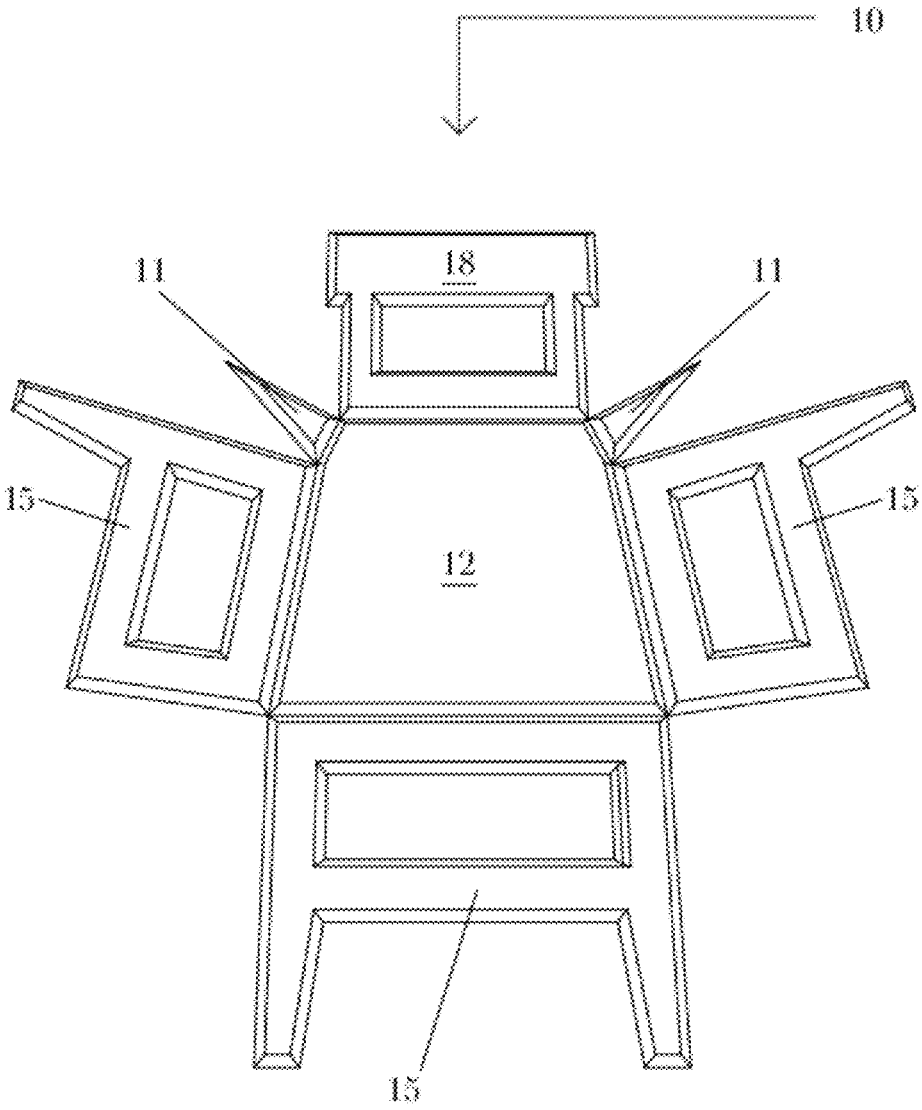
FIG. 2 shows a six-sided embodiment of a reconfigurable furniture piece in accordance with the present invention.
Figure 3:
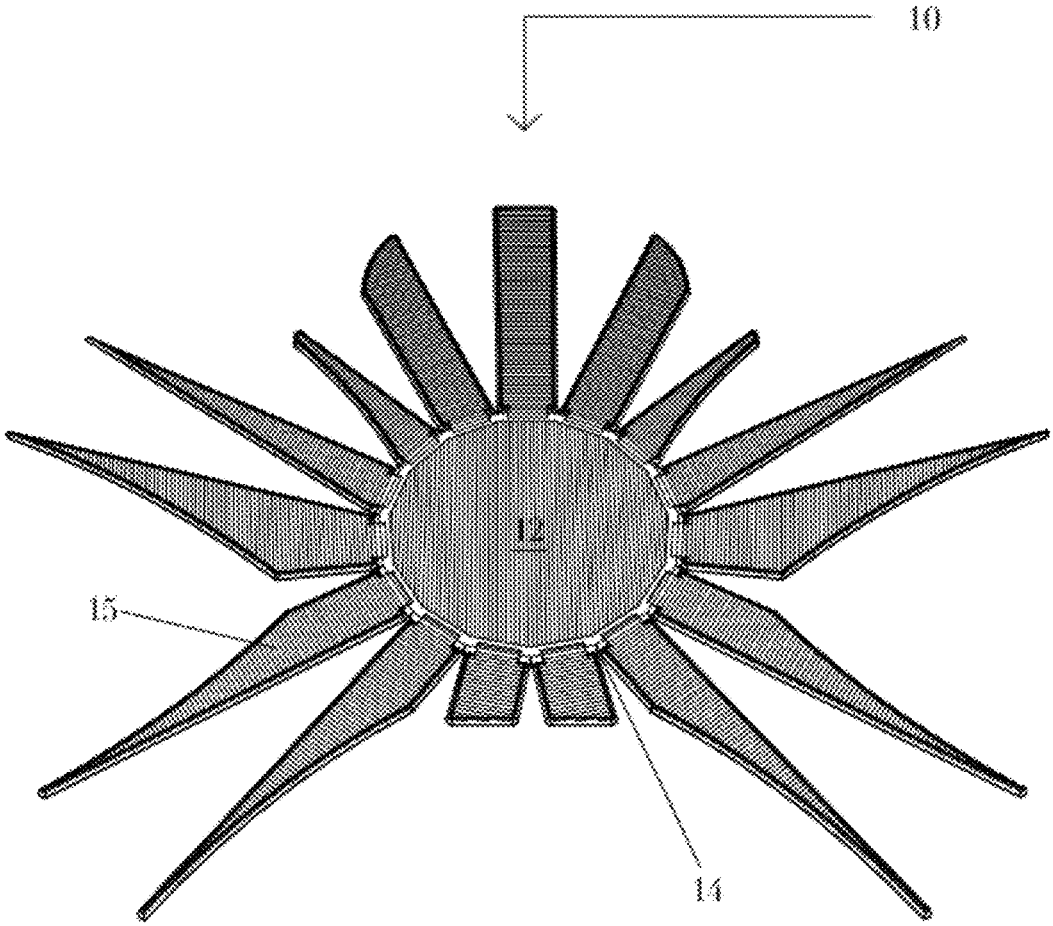
FIG. 3 shows a 15-sided embodiment of a reconfigurable furniture piece in accordance with the present invention.
Figure 4:
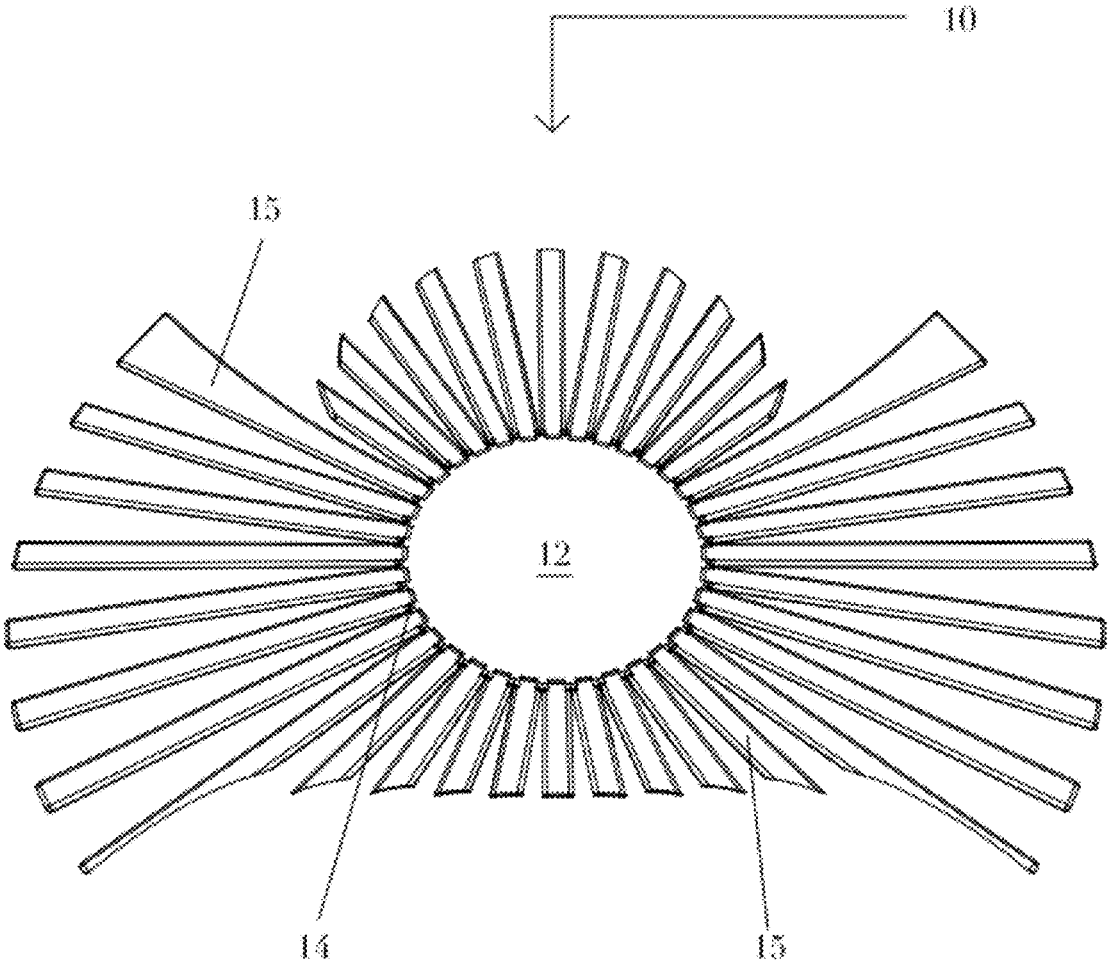
FIG. 4 shows an embodiment of a reconfigurable furniture piece having 36 radiating members in accordance with the present invention.

Referring to FIGS. 1-4, there are shown various two-dimensional (2-D) embodiments of patterns for reconfigurable furniture pieces, each having a different number of radiating members. More particularly, FIG. 1 shows a furniture piece 10 having four radiating members 15. FIG. 2 shows a furniture piece 10 having six radiating members 15. FIG. 3 shows a furniture piece 10 having 15 radiating members 15. FIG. 4 shows a furniture piece 10 having 36 radiating members 15.

Each furniture piece 10 includes a central base portion 12 from which radiate plural radiating members 15. The radiating members 15 are pivotably or foldably attached to the central base portion 12 using pivoting members 14 that are adapted to enable the radiating members 15 to pivot or fold towards either face (top or bottom) of the central base portion 12. Additional conjugate fastening members (not shown) of various types are provided on the radiating members 15 to secure adjacent radiating members 15 when forming a three-dimensional (3-D) configuration.

Figure 5:
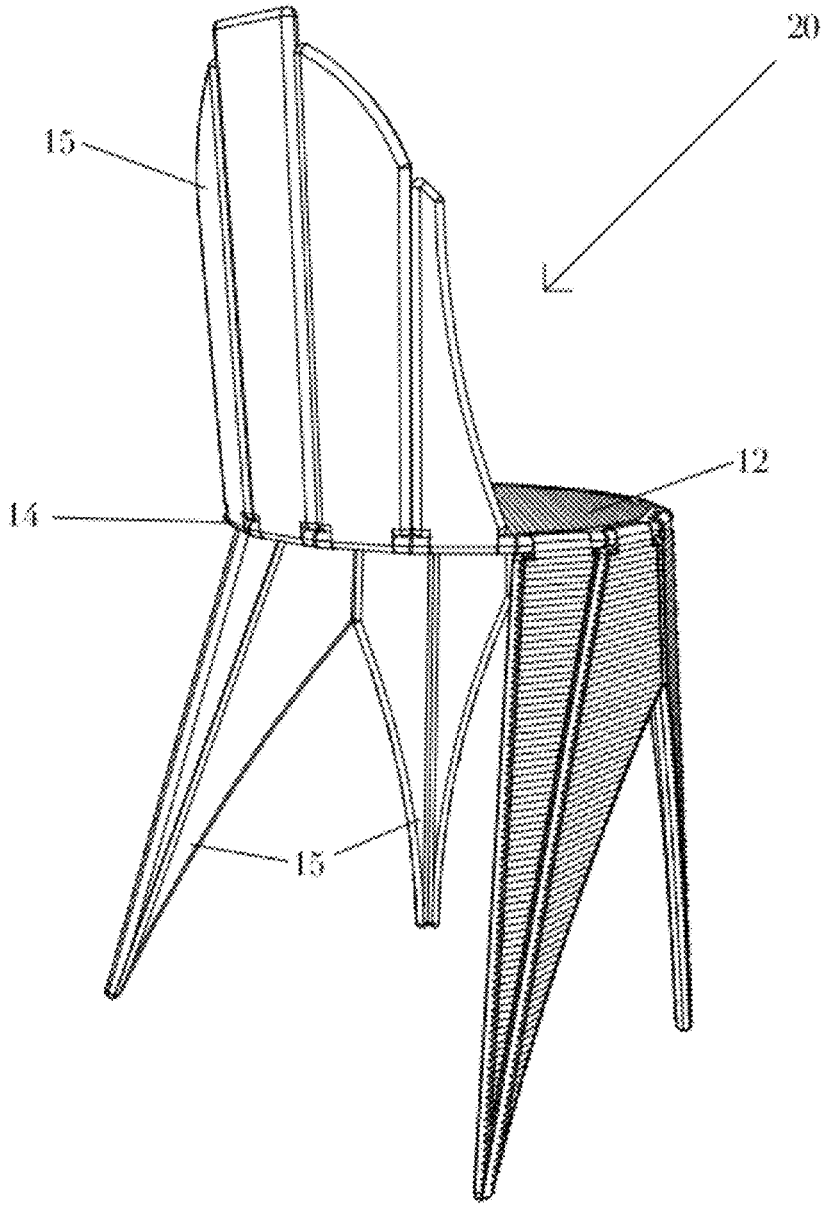
FIG. 5 shows the furniture piece of FIG. 3 reconfigured as a chair in accordance with the present invention.
Figure 6:
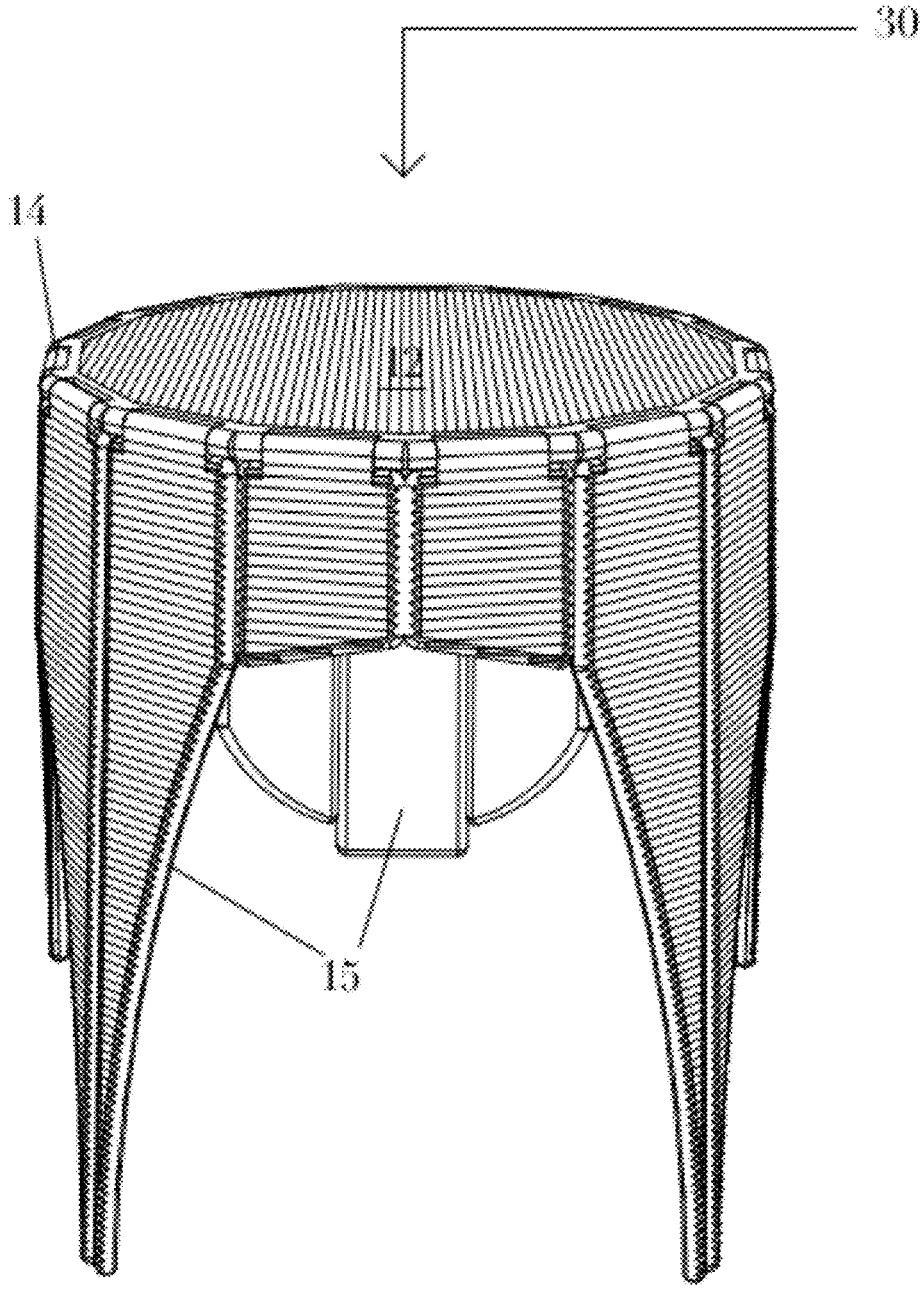
FIG. 6 shows the furniture piece of FIG. 3 reconfigured as a table or footrest in accordance with the present invention.
Figure 7:
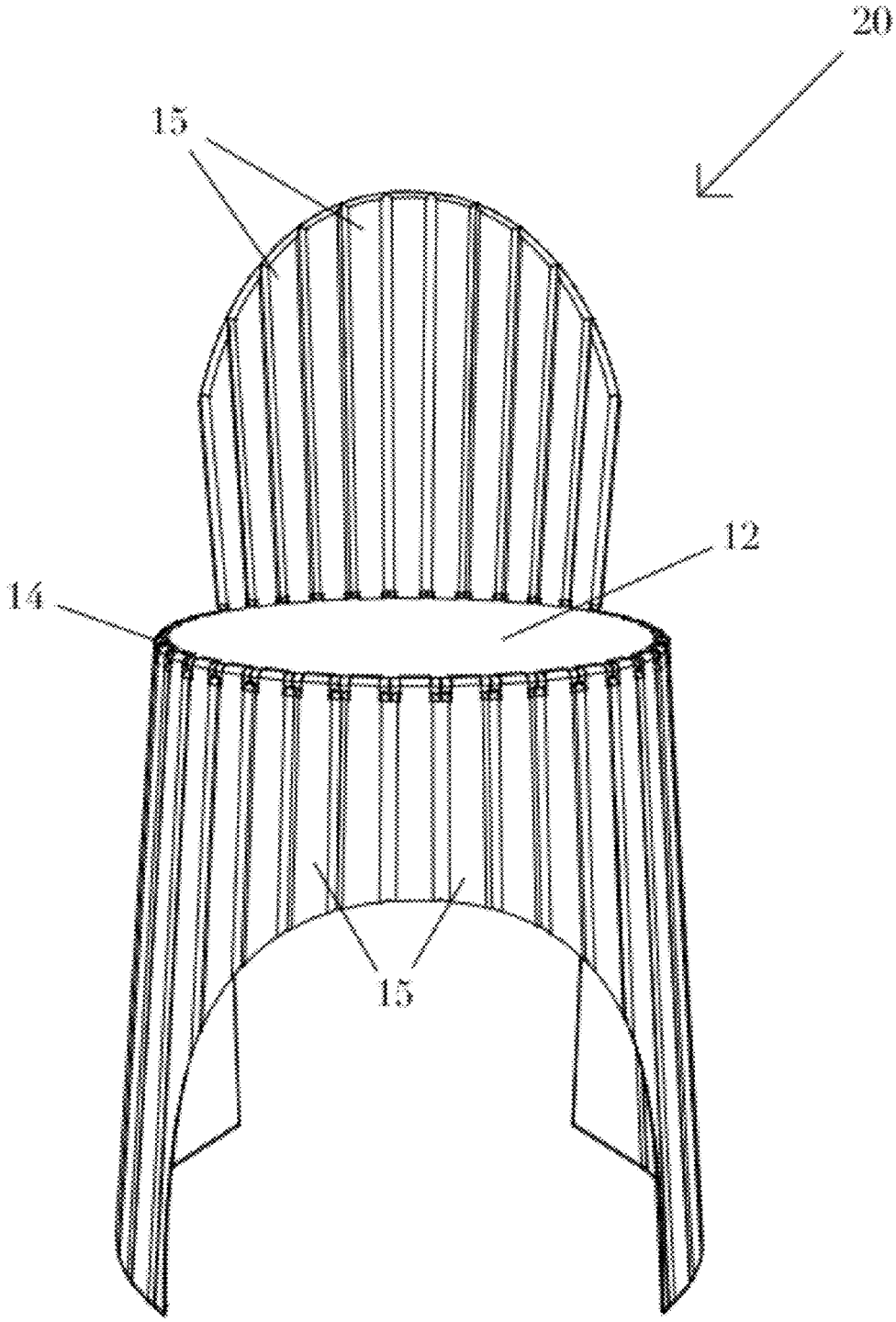
FIG. 7 shows the furniture piece of FIG. 4 reconfigured as a chair in accordance with the present invention.
Figure 8:
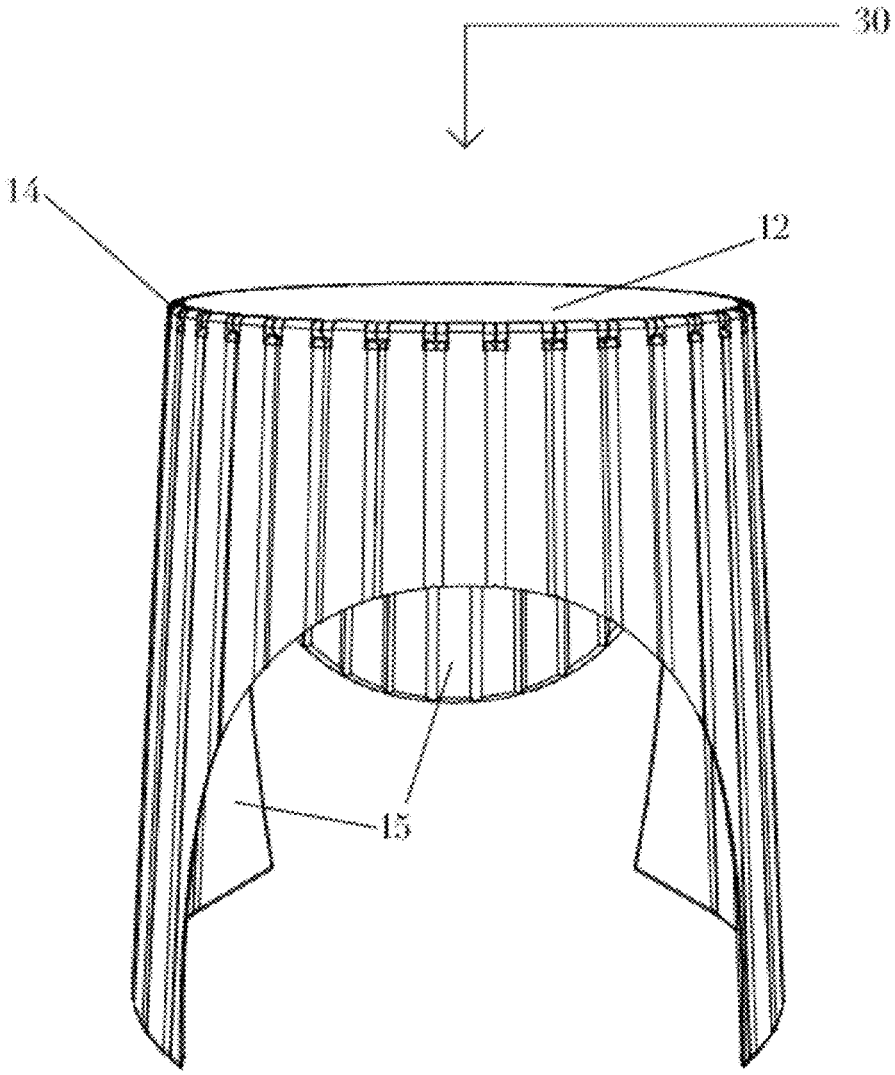
FIG. 8 shows the furniture piece of FIG. 4 reconfigured as a table or footrest in accordance with the present invention.

Advantageously, the arrangement of pivoting radiating members 15 about a central base portion 12 generates a reconfigurable furniture piece 10 that, in a 3-D configuration, can produce a "planar" furniture piece having a substantially horizontal upper surface, e.g., table, stool, footrest, ottoman, and the like, and/or a dual-sided, seating piece, e.g., chair, bar stool, and the like. For example, FIG. 5 and FIG. 7 show four-legged chair embodiments 20 for, respectively, the embodiments shown in FIG. 3 and FIG. 4. FIG. 6 and FIG. 8 show corresponding "stool" embodiments 30 also for, respectively, the embodiments shown in FIG. 3 and FIG. 4.

Figure 9:
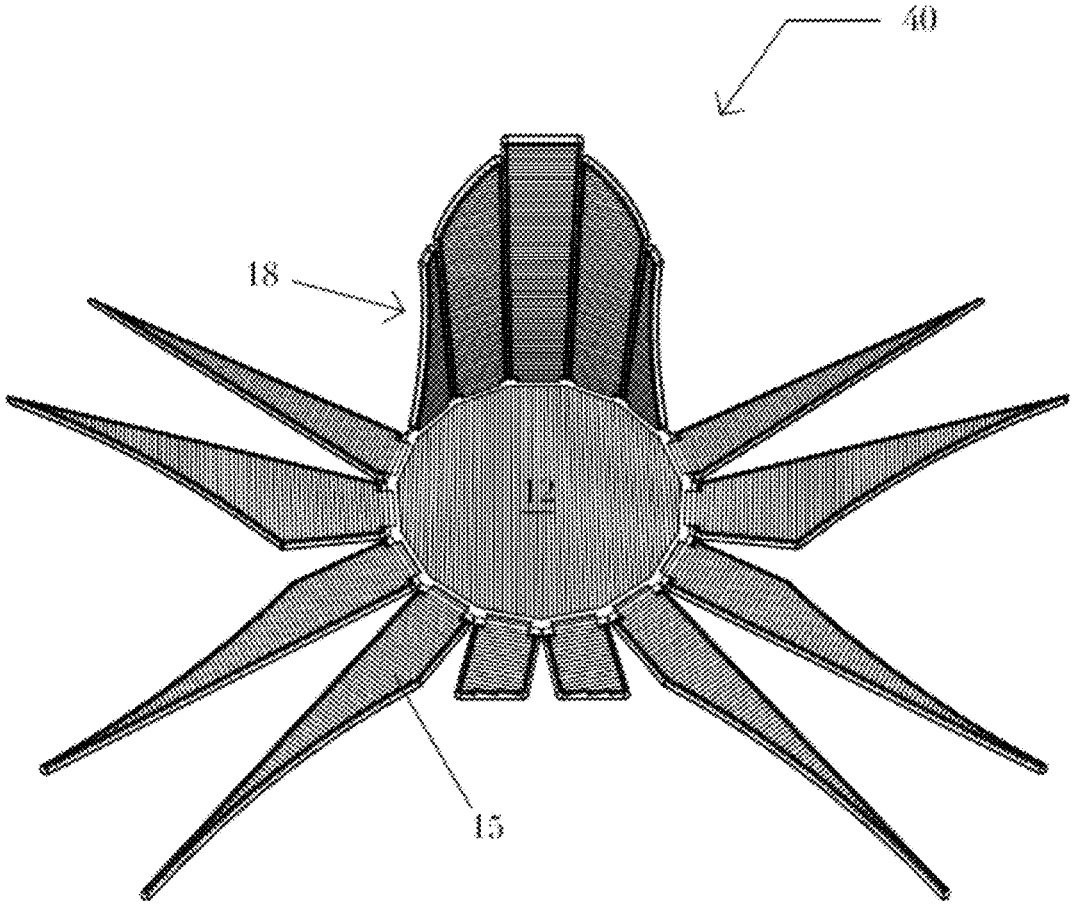
FIG. 9 shows the furniture piece of FIG. 3 configured for stacking with the backrest extended in accordance with the present invention.
Figure 10:
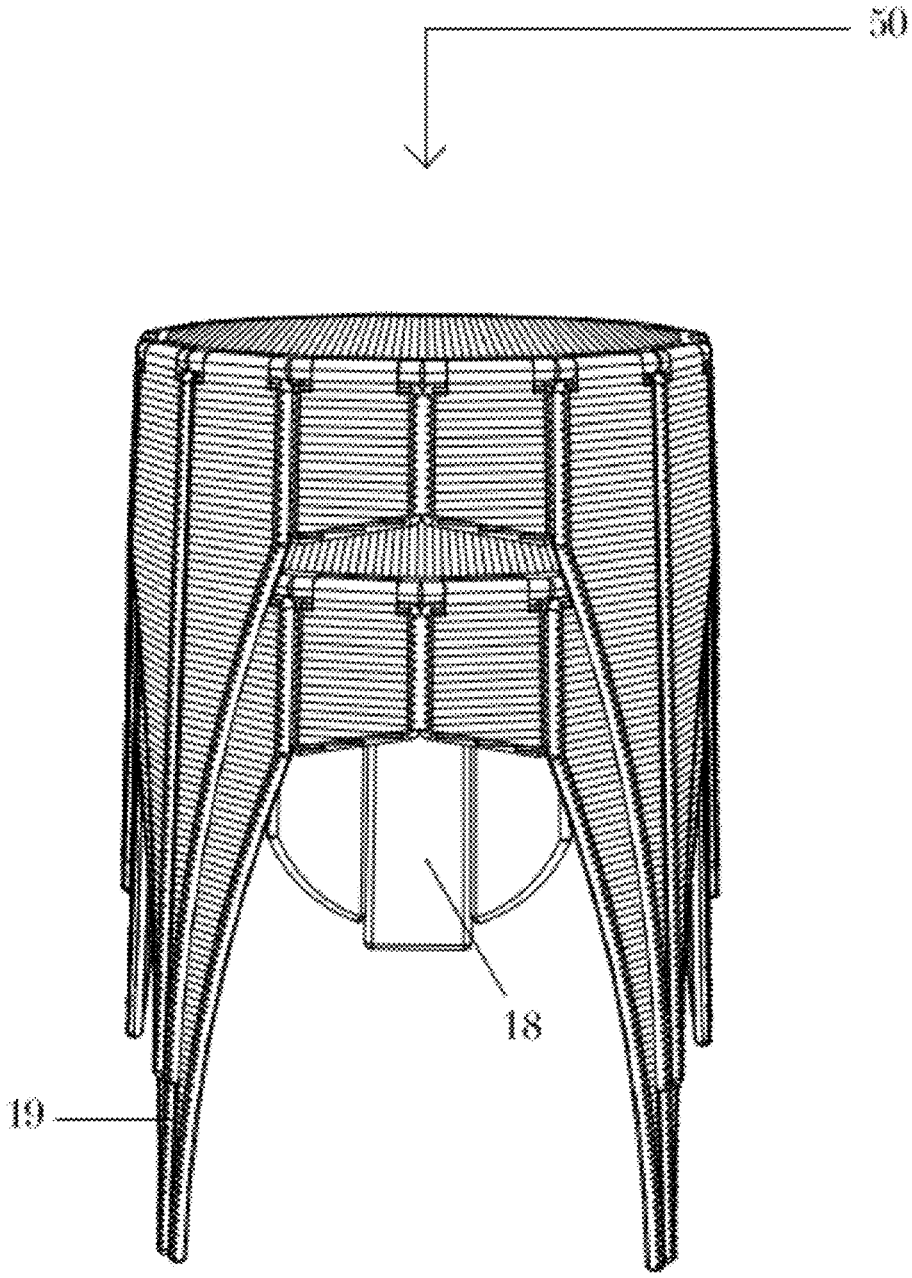
FIG. 10 shows plural furniture table or footrest pieces of FIG. 6 configured for stacking in accordance with the present invention.
Figure 11:
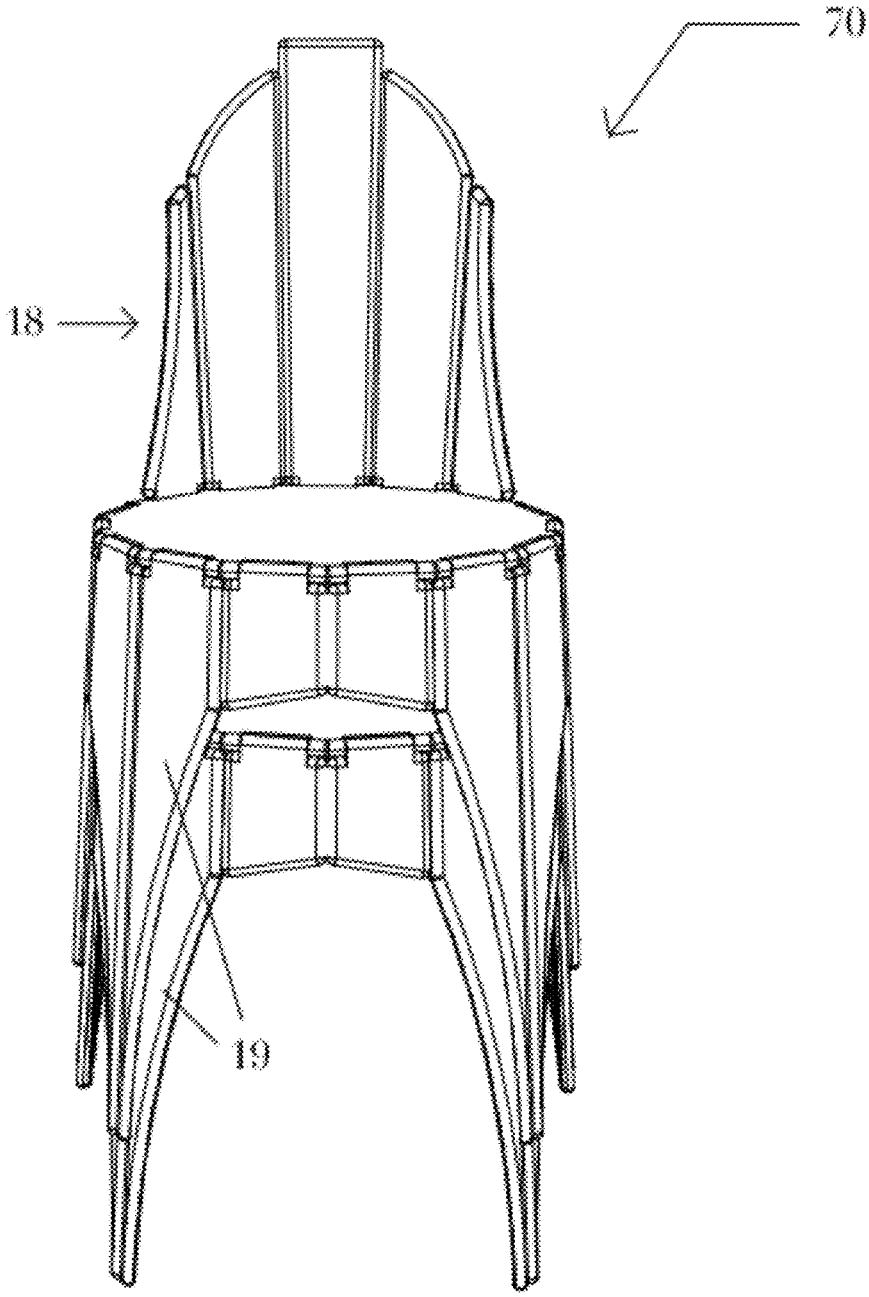
FIG. 11 shows plural furniture chairs of FIG. 5 configured for stacking in accordance with the present invention.

The reconfigurable arrangement of pivoting radiating members 15 about a central base portion 12 promotes a variety of stacking and storage options. For example, in a 2-D configuration, furniture pieces 10 can be stacked in a fully flattened position, one atop another. Additionally, in a 3-D configuration 40, furniture pieces 10 can be stacked with some radiating members 15 arranged coplanar with the central base portion 12 and a backrest portion 18 pivoted and secured orthogonally in an upright, functional position (FIG. 9); as stacked tables 50, with the backrest portion 18 and the support portion (legs) 19 pivoted and secured in a down position (FIG. 10); and/or as stacked chairs 70, with the backrest portion 18 pivoted and secured in an upright, functional position and the legs 19 folded and secured in the down position (FIG. 11).

The central base portion 12 can be a simple geometric shape that is circular, oval, or polygonal, having, if polygonal, sides of equal or unequal length. When the shape of the central base portion 12 is polygonal, the number of sides (n) of equal or unequal length is preferably equal to the number of cooperating radiating members 15. For example, in the embodiment of FIG. 1, the four radiating members 15 require the central base portion 12 to be a rectangle; in the embodiment of FIG. 3, the 15 radiating members 15 require the central base portion 12 to be a 15-sided polygon; and so forth. Each of the n sides of the polygonal central base portion 12 can have the same length and the angle between adjacent sides can be identical (FIG. 3). Alternatively, the lengths of the base sides and the angles between adjacent sides can differ (FIG. 2).

As shown in FIGS. 1-4, the radiating members 15 can assume a myriad of shapes, lengths, and/or sizes. Further, the radiating members 15 can have a simple geometrical shape, e.g., a rectangular, triangular or substantially triangular, or more complex, non-geometric shapes. Moreover, radiating members 15 are structured and arranged to be arrayed in a symmetrical or asymmetrical pattern with respect to the central base portion 12 and each other.

The versatility of the form of the reconfigurable furniture pieces 10 will now be described. As more clearly seen in FIGS. 1-8, the reconfigurable furniture 10 is structured and arranged so that the radiating members 15 can be oriented in different ways to provide different furniture pieces. For example, the four-member embodiment in FIG. 1 can function as a reversible stool or table without a backrest portion when all of the radiating members 15 are pivoted and secured on the same side of the central base portion 12. Because the radiating members 15 can be pivoted to be arrayed on either side of the central base portion 12, the furniture piece 10 is dual-sided.

The 15-member embodiment of FIG. 3 and/or the 36-member embodiment of FIG. 4 are structured and arranged to function in a first application as a reversible chair 20 or bar stool having a backrest portion 18 (FIG. 5 and FIG. 7) or, in another application, as a stool, table, ottoman or footrest 30 (FIG. 6 and FIG. 8). Indeed, radiating members 15 are adapted to pivot or fold bi-directionally, to function as different features of a desired furniture piece 10 as, for example, a table or chair leg 19 or as a backrest portion 18 for a chair, and the like. For improved stability, selected radiating members 11 are provided to buttress other radiating members 15, such as radiating members 15 that form backrest portions 18 (FIG. 2) or chair legs 19.

In some applications, groups or sets of adjacent radiating members 15 provide a specific aspect or feature of the furniture piece 10, e.g., a leg 19, a backrest portion 18, and so forth. While, in other orientations or applications, the same radiating members 15 collectively or severally can provide a different feature or aspect of the furniture piece 10 when reconfigured. For example, a group of adjacent radiating members 15 can pivot or fold in one direction to become, for example, a front support portion 19 (or a section of a leg or base), or the same radiating member 15 or group of radiating members 15 can pivot or fold in an opposite direction to become a backrest portion 18, armrest, and the like (or only a section of any of these aspects or features).

More particularly, in some applications (FIG. 5 and FIG. 7), a first plurality of radiating members 15 can be pivoted in a first direction with respect to the central base portion 12, e.g., upwards, and secured, to form a backrest portion 18, while a second plurality of radiating members 15 can be pivoted in a direction opposite of the radiating members 15 comprising the backrest portion 18 and secured, to provide a support portion 19. In other applications (FIG. 6 and FIG. 8), both the first and second pluralities of radiating members 15 are pivoted or folded and secured in a common direct with respect to the central base portion 12.

As mentioned briefly above, the various components of the furniture piece 10 can be fabricated from a wide variety of materials, e.g., steel, aluminum, titanium, and various alloys that is pressed, cast, rolled, sheet, tubing, and/or bar; wood or plywood; carbon fiber; polymers; composite material; plastic, including injection molded plastic; and any combination thereof. Those of ordinary skill in the art can appreciate that the materials listed herein are illustrative and are not meant to be construed as limiting the scope of the invention. Depending on the application, radiating members 15 can also be made of flexible materials that are tapered and/or flanged, to create curved surfaces when adjacent radiating members 15 are conjoined (similar to the fluted pedal pattern of a tulip).

Optionally, the components can be painted, textured or upholstered on one or both sides. Upholstery can include most materials typically employed by the furniture industry for this purpose. A variety of colors and fabric materials and combination of colors and materials is also envisioned. For example, the central base portion 12 and/or the radiating members 15 can be made of cut and press-formed aluminum sheet, which can be left exposed on one side while a thin leather cushion can cover all surfaces on the opposite face. This option is particularly useful in switching the function of the reconfigurable furniture piece 10 from that of a leather cushioned chair to a hard, level, easily cleanable, metal-topped table.

As previously provided, each radiating member 15 is structured and arranged to pivot or fold along and with respect to a corresponding edge of the central base portion 12. Those of ordinary skill in the art can appreciate, however, that there can be more than one radiating member disposed on each edge of the central base portion 12. The angle of rotation or degree of freedom over which the radiating member(s) 15 can pivot in relation to the plane of the central base portion 12 can vary from embodiment to embodiment and application to application. In short, radiating members 15 can be structured and arranged to have identical or different ranges of motion.

The means for pivoting or rotating radiating members 15, i.e., pivoting members 14, about the sides of the central base portion 12 can include, for purposes of illustration and not for reasons of limitation: hinges, which includes friction hinges, quilted seams, two-way or bi-directional springs, spring-loaded catches, and the like. Hinges of various sizes, weights, lengths of knuckles, and so forth can be employed. The type of hinge selected depends, inter alia, on the material(s) from which the radiating members 15 and the central base portion 12 is/are fabricated. In particular, there are various types of "pinless" single-piece hinges, which are made from flexible plastics and/or synthetic rubbers, that are particularly useful and adaptable to the use described herein.

Friction hinges are particularly useful in many applications because they limit the speed at which each of the radiating members 15 moves, which serves three useful purposes. First, manipulation of the radiating members 15 is made easier even though relatively slow. Second, the likelihood of pinching and injury due to pinching digits is reduced. Finally, friction hinges enable the radiating members 15 to remain flat when the 2-D whole is hung or otherwise stored vertically.

The two-way spring and spring-loaded catch options also provide this storage feature. More particularly, the two-way spring can be biased to compel radiating members 15 to return to an open, flat position, while spring-loaded catches can be structured and arranged to retain each piece independently in the flat position.

In a further embodiment, if the furniture piece is upholstered, the pivoting means can include quilted seams of the upholstery material that is covering all or some portion of a radiating member 15 and/or the central base portion 12. For example, for a fully upholstered version, the radiating members 15 and the central base portion 12 can be cut out of a thin, lightweight, rigid material, e.g., aluminum, plastic, and the like, to one or both sides of which an upholstery material, e.g., closed cell foam rubber, polymer fabrics (such as DACRON®), leather, and so forth, can be attached. Heavy stitching can then be performed around the perimeter of the central base portion 12 and around each radiating member 15. The heavy stitching at the edge of the central base portion 12 will be the line about which the corresponding radiating member(s) 15 fold or pivot.

Figure 12:
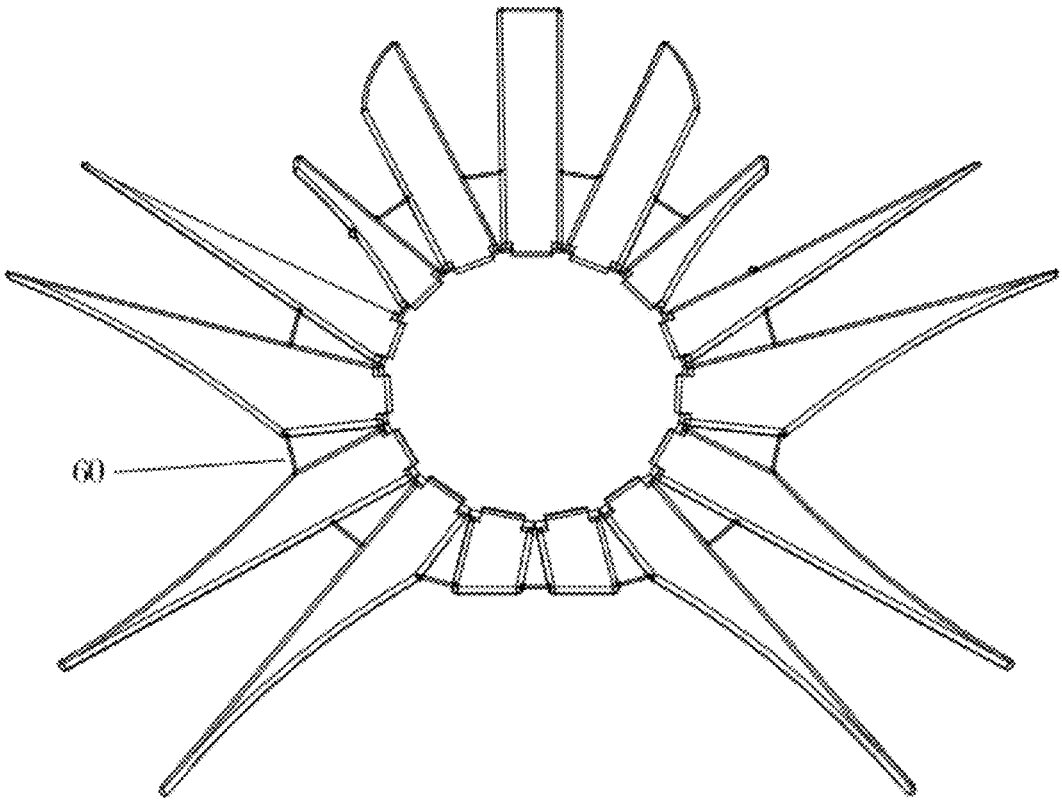
FIG. 12 shows a 15-sided furniture piece having steel draw cables as fasteners in accordance with the present invention.
Figure 13:
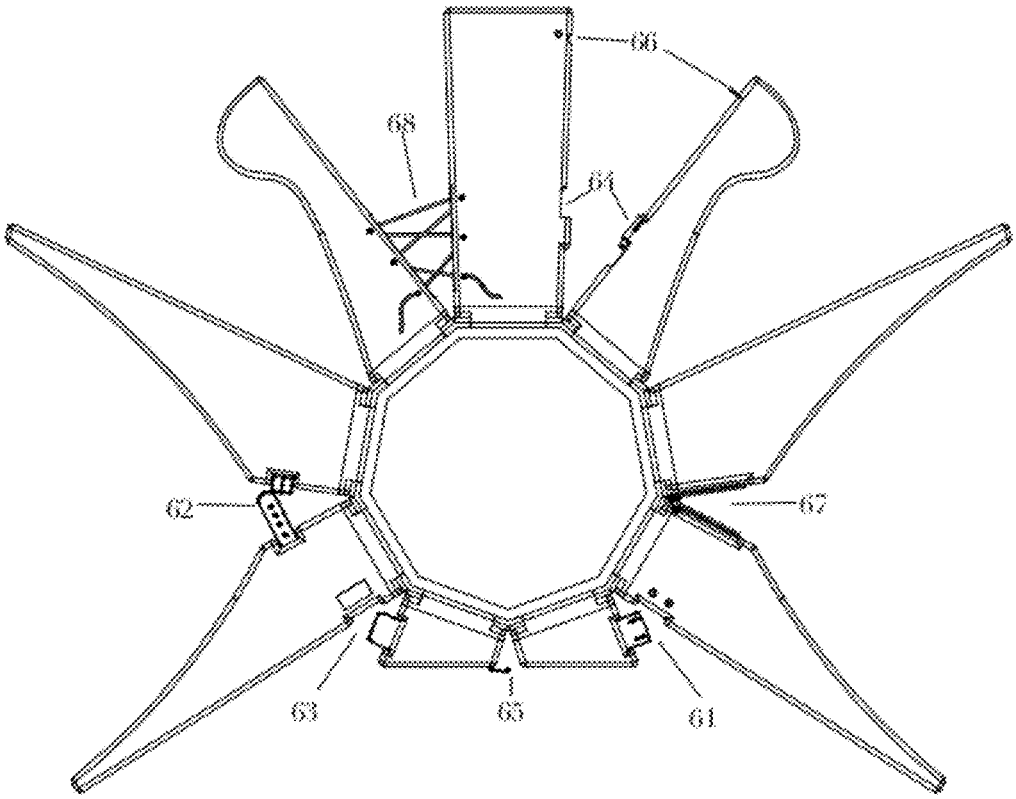
FIG. 13 shows a nine-sided furniture piece with examples of various fasteners in accordance with the present invention.

In order to releasably secure adjacent radiating members 15 to each other, to provide greater strength for load bearing, conjugate fastening members 16 are required between adjacent radiating members 15. Illustrative fastening members are shown in FIGS. 12 and 13. For the purposes of illustration and not limitation, the fastening members can include: buttons 61, buckles 62, VELCRO® 63, barrel latches (deadbolts) 64, hook and eye latches 65, interlocking slide fasteners (zipper) 67, lacing 68 similar to a shoe lace, spring-loaded, steel draw-cables 60, spring-released (button) catches 66, and so forth. The operation of the fastening means 16 listed above are within the purview of those of ordinary skill in the art and will not be described in detail.

Figure 14A:
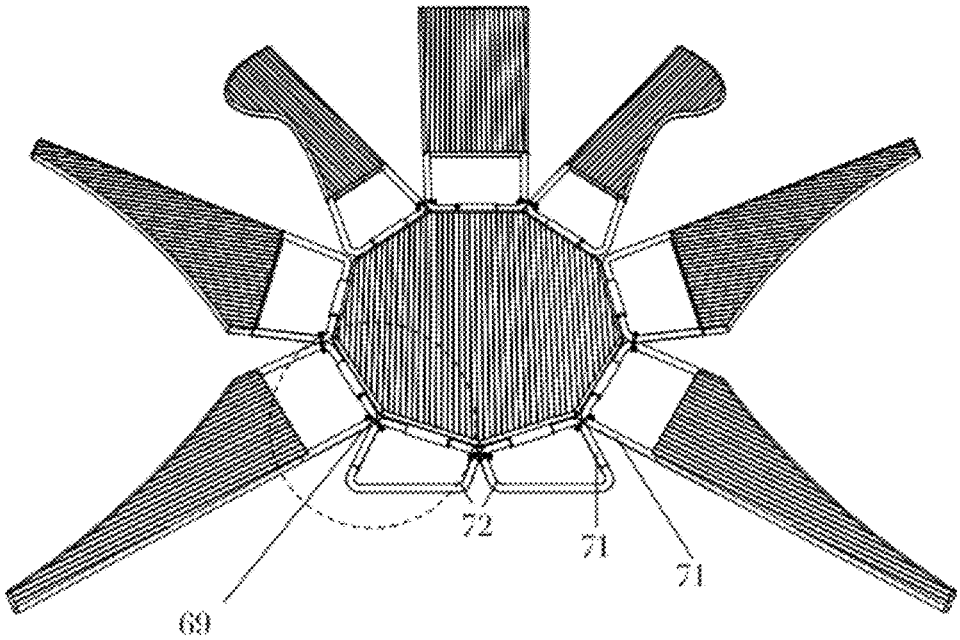
FIG. 14A shows a nine-sided furniture piece with sliding ring fasteners in accordance with the present invention.
Figure 14B:
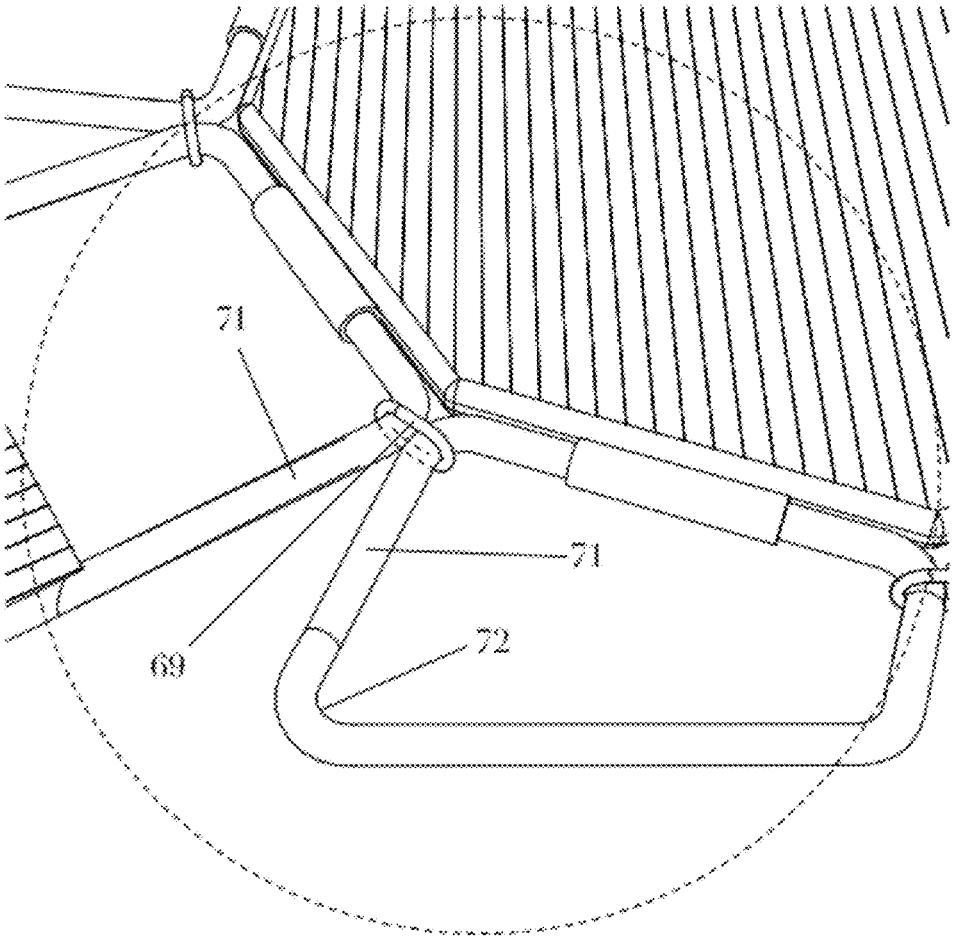
FIG. 14B shows a sliding ring operatively disposed on adjacent tubing or round bar radiating members.

Sliding rings 69 shown in FIGS. 14A and 14B are also well-known and are anticipated for use with tubular or round bar radiating members 15. In operation, when adjacent radiating members 15 are pivoted or folded downwards, gravity causes the sliding ring 69 adjoining the tubing or round bar 71 of adjacent radiating members 15 to slide down to the bottommost position 72 of the tubing or round bar 71. Sliding rings 69 disposed on tubing or round bar 71 of adjacent radiating members 15 that are folded or pivoted upwards are manipulated until sufficient friction between the sliding ring 69 and tubing or round bars 71 provide sufficient strength to the adjacent retaining members 15 to keep them in an erect, upright orientation.

Adjacent radiating members 15 can also include mating channel C-sections (not shown), the ends of which fit into the channel portions of the other C-section, which engage to add rigidity and strength when weight is added to the central base portion 12.

Figure 15:
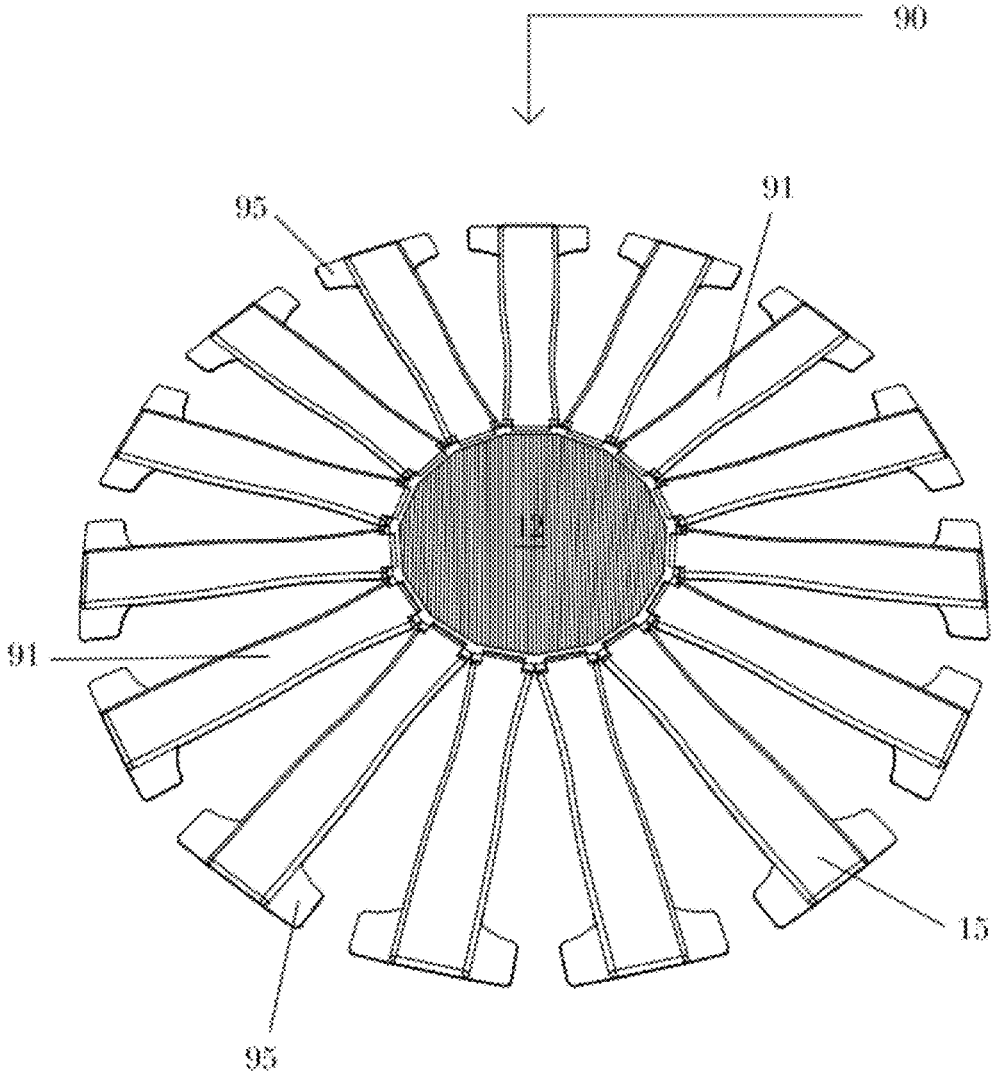
FIG. 15 shows a universal furniture piece with a substantially circular central base portion and identical radiating members with T-shaped end portions in accordance with the present invention.

Referring to FIG. 15, a universal embodiment is shown. In the furniture piece embodiment 90, the radiating members 15 are identical or virtually identical, hence, "universal", which is to say that they can be employed in either the backrest portion or with the support element. More particularly, the radiating members 15 are "T" shaped having an elongate portion 91 whose proximal end is attached to the central base portion 12 and whose distal end includes end portions or wings 95 that form a letter "T".

Unlike previously described embodiments, the mechanism for forming the respective backrest and support portions does not interfere with each radiating member's 15 deployment above or below the plane of the central base portion 12. As a result, the conjugate fastening members 16 between adjacent radiating members 15 in this embodiment can be one or more of those previously listed as well as a frictional fit between the end portions 95 of adjacent radiating members 15.

More specifically, the end portions 95 of radiating members 15 that comprise the backrest portion 18 overlap and are fastened using VELCRO® and the like while the end portions 95 of adjacent radiating members 15 that comprise the support portion 19 are overlapped in a way so that they are retained as a group by the friction generated between their joined end portions 95 in contact with one another.

Figure 16:
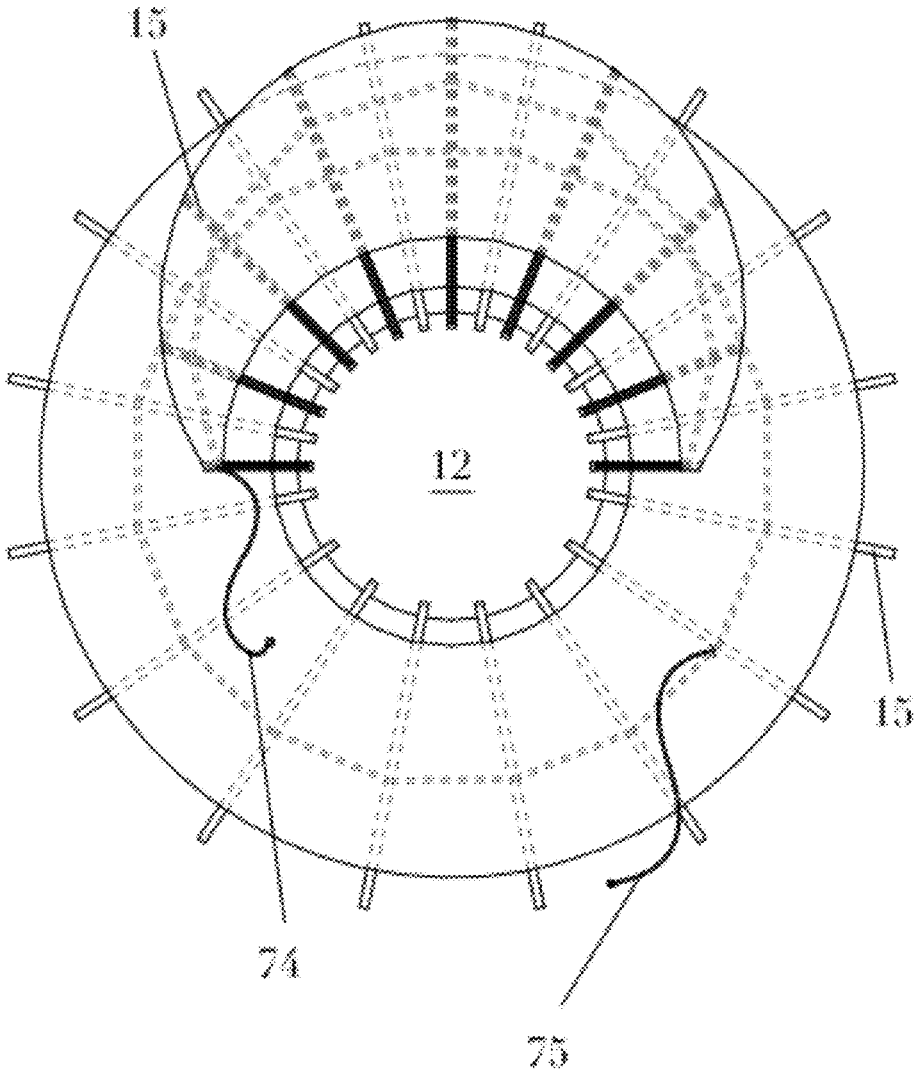
FIG. 16 shows a fan-like or umbrella-like furniture piece with individual draw strings for the backrest portion and the support portion of the furniture piece in accordance with the present invention.

Referring to FIG. 16, a substantially circular central base portion 12 having 25 radiating members 15 is shown. In one application, a first group of nine radiating members 15 (shaded), can be used to form a backrest portion once deployed while a second group of sixteen radiating members 15 (unshaded) can be used to form the support, i.e., legs, of the furniture piece 10 when it is configured as a chair. The radiating members 15 in each of the two groups are joined together by drawstrings 74 and 75, which, when tightened, produce the desired chair. Other joining techniques besides the drawstrings may be used in variations in the embodiment.

Similar to the way a traditional hand held folding fan or umbrella is covered in fabric or paper, the two groups in this embodiment can act as the skeletal structure over which cloth, plastic or leather fabric or paper can be applied. With the drawstrings 74 and 75 cinched and secured, the fabric, paper or other covering would become taut to form a more comfortable surface, especially in the back group.

Figure 17:
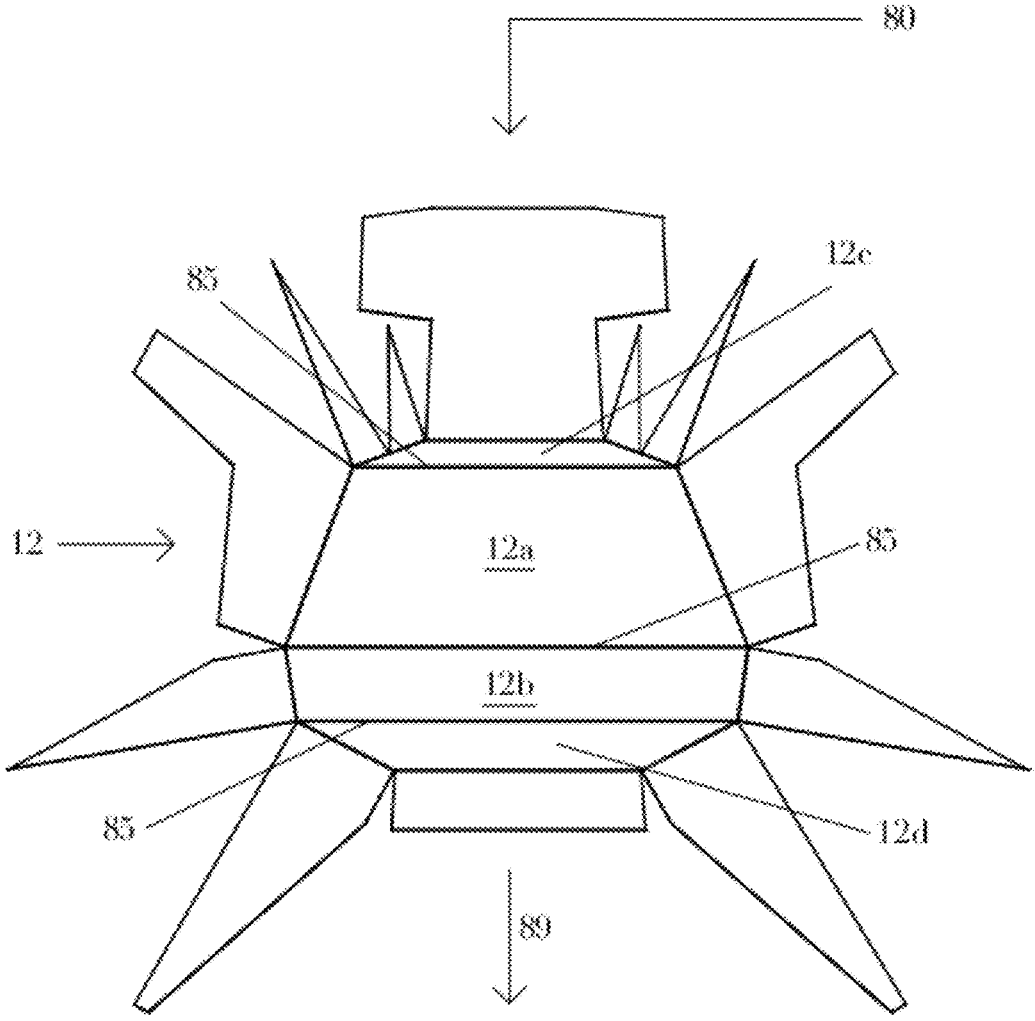
FIG. 17 a 12-sided furniture piece pattern having a central base portion with plural bases pieces in accordance with the present invention.
Figure 18:
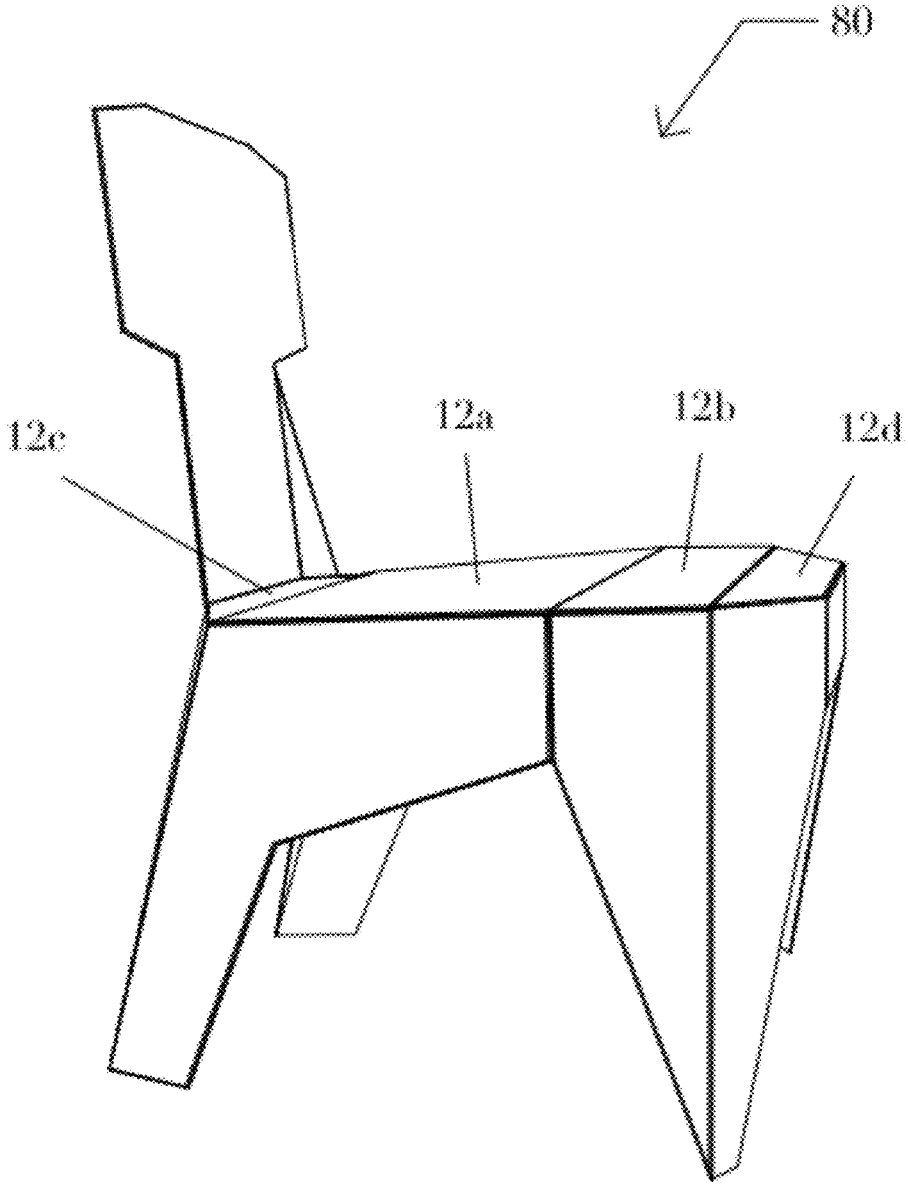
FIG. 18 shows the two-dimensional furniture piece pattern from FIG. 17 erected as a three-dimensional piece of furniture.

Although the invention has been described assuming that he central base portion 12 is a single piece, a further embodiment 80 having a compound base portion 12 with plural portions 12*a*-12*d* is shown in 2-D and 3-D in FIGS. 17 and 18, respectively. Individual portions 12*a*-12*d* of the central base portion 12 are joined along lines 85 orthogonal to the front-back axis of symmetry 89 of the furniture piece 10. This portioning of the central base portion 12 can be done for many reasons, including aesthetics and comfort.

The range of motion between individual portion, e.g., between 12*a* and 12*b* or 12*c*, need not be as great as between the individual portion 12*a*-12*d* and the radiating members 15. For example, the central base portion 12 can include varying angles for additional comfort or aesthetics. The illustrated embodiment 80 is reversible and can employ one or more locking mechanisms 16 to attach adjacent radiating members 15. Optionally, the individual portions 12*a*-12*d* can also fold with respect to each other and/or can include pins that can be removed so that the center base portion 12 can be broken down into smaller pieces for storage in smaller areas.

Many changes in the details, materials, and arrangement of parts and steps, herein described and illustrated, can be made by those skilled in the art in light of teachings contained hereinabove. Accordingly, it will be understood that the following claims are not to be limited to the embodiments disclosed herein and can include practices other than those specifically described, and are to be interpreted as broadly as allowed under the law.

What I claim is:

1. A reconfigurable piece of furniture having a two-dimensional pattern for storage and multiple three-dimensional functional patterns, the furniture piece comprising:

a central base portion of circular, oval or polygonal shape having a first surface and a second surface and a plurality of pivoting members disposed at discrete locations along an edge thereof;

a plurality of radiating members bi-directionally pivotally or foldably attached to the central base portion via a corresponding pivoting member of the plurality of pivoting members; and a plurality of fastening members disposed on corresponding portions of radiating members for releasably securing, adjacent radiating members together when the radiating members are pivoted or folded relative to the central base portion and when mutually adjacent to one another, thereby providing any of the three-dimensional functional patterns, wherein a first portion of the plurality of radiating members is pivotable relative to the central base portion to provide a support portion for the piece of furniture and wherein a second portion of the plurality of radiating members is pivotable relative to the central base portion in a direction opposite to the first portion, to provide at least one of a backrest portion and an armrest portion for the piece of furniture.

2. The piece of furniture as recited in claim 1, wherein the plurality of pivoting members is selected from the group consisting of hinges, friction hinges, pinless hinges, bidirectional springs, spring-loaded catches, heavy stitching, and quilted seams.

3. The piece of furniture as recited in claim 1, wherein the plurality of fastening members is selected from the group consisting of buttons, buckles, VELCRO® strips, barrel latches, deadbolts, hook and eye latches, interlocking slide fasteners, laces and eyelets, spring-loaded, steel draw-cables, spring-released latches, drawstrings, sliding rings, and interlocking channel sections.

4. The piece of furniture as recited in claim 1, wherein the central base portion includes:

a plurality of individual base portions, each providing at least one edge of the central base portion and, further, having at least one of the plurality of pivoting members, each of the plurality of individual base portions being pivotable with respect to at least one other of said plurality of individual base portions.

5. The piece of furniture as recited in claim 1, wherein each of the plurality of radiating members is pivotable or foldable about the central base portion in a first direction for use to support an object placed on the first surface of the central base portion and pivotable or foldable about the central base portion in a second, opposite direction for use to support an object placed on the second surface of the central base portion.

6. The piece of furniture as recited in claim 1, wherein each of the plurality of radiating members is identical in shape, size, and dimension.

7. The piece of furniture as recited in claim 1, wherein each of the plurality of radiating members is structured and arranged to include an end portion that provides frictional contact between adjacent end portions when said plurality of radiating members is pivoted or folded.

8. The piece of furniture as recited in claim 1, wherein at least one side of the central base portion is upholstered or textured.

9. The piece of furniture as recited in claim 1, wherein at least one side of the plurality of radiating members is upholstered or textured.

10. The piece of furniture as recited in claim 1, wherein the plurality of radiating members is manufactured from wood, plywood, carbon fiber, polymers, composite materials, plastic, including injection molded plastic, steel, aluminum, titanium, and alloys thereof and any combination thereof.

11. The piece of furniture as recited in claim 10, wherein the plurality of radiating members is manufactured from a material that is pressed, cast, rolled, sheet, tubing, and/or bar.

12. The piece of furniture as recited in claim 1, wherein, for storage, the piece of furniture is structured and arranged to be stackable or nested in a three-dimensional configuration.

13. A method of reconfiguring a two-dimensional pattern into a three-dimensional piece of furniture, the two-dimensional pattern including a central base portion having a shape that includes a first surface and a second surface and having a plurality of pivoting members disposed at discrete location along an edge thereof, a plurality of radiating members that are bi-directionally pivotally or foldably attached to a corresponding pivoting member of the plurality of pivoting members, and a plurality of fastening members disposed on corresponding portions of the plurality of radiating members, the method comprising:

pivoting or folding a first portion of said plurality of radiating members towards at least one of the first and second surfaces to generate a three-dimensional pattern, to provide a support portion for the piece of furniture;

pivoting or folding a second portion of said plurality of radiating members relative to the central portion in a direction opposite of the first portion, to provide at least one of a backrest portion and an armrest portion for the piece of furniture; and releasably securing corresponding first and second portions of radiating members to adjacent radiating members to provide structure to generate the three-dimension piece of furniture.

14. The method as recited in claim 13, wherein pivoting or folding includes using a plurality of pivoting members selected from the group consisting of hinges, friction hinges, pinless hinges, bidirectional springs, spring-loaded catches, heavy stitching, and quilted seams.

15. The method as recited in claim 13, wherein releasably securing includes using the plurality of fastening members selected from the group consisting of buttons, buckles, VELCRO® strips, barrel latches, deadbolts, hook and eye latches, interlocking slide fasteners, laces and eyelets, spring-loaded, steel draw-cables, spring-released latches, drawstrings, sliding rings, and interlocking channel sections.

16. The method as recited in claim 13, further comprising:

sub-diving the central base portion into a plurality of individual base portions, each providing at least one edge of the central base portion and, further, having at least one of the plurality of pivoting members; and pivotably attaching each of the plurality of individual base portions to at least one other of said plurality of individual base portions.

17. The method as recited in claim 13, further comprising:

supporting an object placed on the first surface of the central base portion by pivoting or folding the plurality of radiating members about the central base portion in a first direction; and supporting an object placed on the second surface of the central base portion by pivoting or folding the plurality of radiating members about the central base portion in a second, opposite direction.

18. The method as recited in claim 13 further comprising pivoting or folding at least one of first and second portions of said plurality of radiating members in such a manner so that the three-dimensional piece of furniture can be stacked or nested with other three-dimensional pieces of furniture.

* * * * *